US009360191B2

(12) United States Patent
Nakamura

(10) Patent No.: US 9,360,191 B2
(45) Date of Patent: Jun. 7, 2016

(54) LIGHTING DEVICE

(71) Applicant: Enplas Corporation, Saitama (JP)

(72) Inventor: Masato Nakamura, Saitama (JP)

(73) Assignee: Enplas Corporation, Saitama (JP)

( * ) Notice: Subject to any disclaimer, the term of this patent is extended or adjusted under 35 U.S.C. 154(b) by 285 days.

(21) Appl. No.: 14/086,055

(22) Filed: Nov. 21, 2013

(65) Prior Publication Data

US 2014/0177231 A1 Jun. 26, 2014

(30) Foreign Application Priority Data

Nov. 22, 2012 (JP) ..... 2012-255939

(51) Int. Cl.
*F21V 7/04* (2006.01)
*F21V 13/04* (2006.01)
*F21K 99/00* (2016.01)

(52) U.S. Cl.
CPC ..... *F21V 13/04* (2013.01); *F21K 9/135* (2013.01); *F21K 9/1355* (2013.01); *F21K 9/50* (2013.01)

(58) Field of Classification Search
CPC ..... F21V 5/045; F21V 7/0008; F21V 7/041; F21V 13/04; F21V 17/12
IPC ..... F21V 5/045
See application file for complete search history.

(56) References Cited

U.S. PATENT DOCUMENTS

2006/0083003 A1* 4/2006 Kim ..... F21V 5/04 362/327
2006/0083017 A1* 4/2006 Wang ..... B64F 1/20 362/547
2007/0267976 A1 11/2007 Bohler et al.
2011/0149579 A1* 6/2011 Chiang ..... F21V 5/046 362/296.01
2011/0215696 A1* 9/2011 Tong ..... F21K 9/00 313/46
2011/0267836 A1* 11/2011 Boonekamp ..... F21K 9/52 362/555
2011/0273900 A1* 11/2011 Li ..... F21K 9/135 362/555
2012/0161626 A1* 6/2012 van de Ven ..... F21K 9/135 315/35
2014/0177231 A1* 6/2014 Nakamura ..... F21V 13/04 362/308

FOREIGN PATENT DOCUMENTS

JP 2011-165675 A 8/2011

* cited by examiner

*Primary Examiner* — Julie Bannan
(74) *Attorney, Agent, or Firm* — Brundidge & Stanger, P.C.

(57) ABSTRACT

The present invention relates to a lighting device. Light flux controlling member 120 of lighting device 100 according to the present invention distributes light emitted from light emitting element 110 at least sideward and rearward. The light emitted from light flux controlling member 120 is diffused and transmitted to a cover. Housing 170 is formed in a shape that does not block a main component of the light emitted rearward from light flux controlling member 120. Lighting device 100 can distribute the emitted light from light emitting element 110 forward, sideward and rearward in all directions.

3 Claims, 14 Drawing Sheets

LIGHTING DEVICE

CROSS REFERENCE TO RELATED APPLICATIONS

This application is entitled to and claims the benefit of Japanese Patent Application No. 2012-255939, filed on Nov. 22, 2012, the disclosure of which including the specification, drawings and abstract is incorporated herein by reference in its entirety.

TECHNICAL FIELD

The present invention relates to a lighting device having a light emitting element.

BACKGROUND ART

In recent years, from a viewpoint of saving energy and protecting environment, a lighting device (for example, LED light bulb) whose light source is a light emitting diode (hereinafter, also referred to as an "LED") has been used in place of an incandescent lamp.

As such a lighting device, a lighting device illustrated in FIG. 1 has been known (for example, refer to PTL 1). FIG. 1 is a schematic diagram illustrating a configuration of the lighting device disclosed in PTL 1. Lighting device 10 illustrated in FIG. 1 has LED 11 in the center, light emission surface 12 which emits light forward, substantially spherical-shaped cover 13 which is integrally formed from light emission surface 12, and Edison screw 14 which is connected to LED 11 and cover 13. Lighting device 10 is formed into a shape similar to the incandescent lamp as a whole.

CITATION LIST

Patent Literature

PTL 1
Japanese Patent Application Laid-Open No. 2011-165675

SUMMARY OF INVENTION

Technical Problem

Light distribution of the lighting device disclosed in PTL 1 is determined only by light diffusion of the cover, thereby the light distribution being biased forward. Accordingly, the lighting device cannot emit light toward a wide range direction like the incandescent lamp. Therefore, the lighting device cannot extensively illuminate a room by using reflected light from a ceiling or a wall surface like the incandescent lamp.

The present invention provides a lighting device which has a light emitting element and can distribute light toward a forward, lateral and rear directions of the lighting device.

Solution to Problem

A lighting device according to the present invention includes: a light emitting element for emitting light toward a forward direction of the lighting device;

a light flux controlling member for emitting a part of light, the light being emitted toward the forward direction from the light emitting element, toward a lateral direction or a rear direction of the lighting device, the light flux controlling member being arranged on an optical axis of the light emitting element, and comprising a first light flux controlling member and a second light flux controlling member;

a cover that covers the light flux controlling member for transmitting light emitted from the light flux controlling member with the light being diffused; and a housing that supports the light emitting element, the light flux controlling member and the cover, wherein the first light flux controlling member is arranged opposing the light emitting element for emitting a part of light that is emitted from the light emitting element and reaches the first light flux controlling member toward the second light flux controlling member, the second light flux controlling member has a reflection surface that faces to an emission surface of the first light flux controlling member for reflecting a part of light emitted from the first light flux controlling member and reaches the second light flux controlling member, and for transmitting the remaining light, the reflection surface is a rotationally symmetric surface whose rotation axis is the optical axis, and a generating line of the rotationally symmetric surface is formed to be a concave curve with respect to the first light flux controlling member, an outer peripheral portion of the reflection surface is disposed at a position away from the light emitting element in a direction of the optical axis, compared to a central portion of the reflection surface, and the housing is formed into a shape so that $\alpha$ is $\theta$ or greater in any cross-section including the optical axis, where $\alpha$ is one of two obtuse angles formed between an extension line of a tangent that comes into contact with the housing from an outer rim of the reflection surface and the optical axis, the $\alpha$ being the one obtuse angle positioned more forwardly than the other obtuse angle; and $\theta$ represents an angle of an emitting direction of light that indicates peak intensity at rearward in distribution of luminous intensity of the light emitted from the light flux controlling member, provided that an angle of an emitting direction of light emitted forward from the light flux controlling member along the optical axis is set to 0°.

Advantageous Effects of Invention

The lighting device according to the present invention can distribute light toward a forward, lateral and rear directions of the lighting device. Therefore, according to the present invention, there is provided a lighting device which can distribute the light toward a forward, lateral and rear directions of the lighting device with good balance and can extensively illuminate a room by utilizing the light reflected from a ceiling or a wall surface like an incandescent lamp.

DESCRIPTION OF EMBODIMENTS

Hereinafter, embodiments of the present invention will be described in detail with reference to the accompanying drawings. In the following description, as a representative example of a lighting device according to the present invention, a lighting device will be described which can be used in place of an incandescent lamp.

(Embodiment 1)

(Configuration of Lighting Device)

Figure 1:
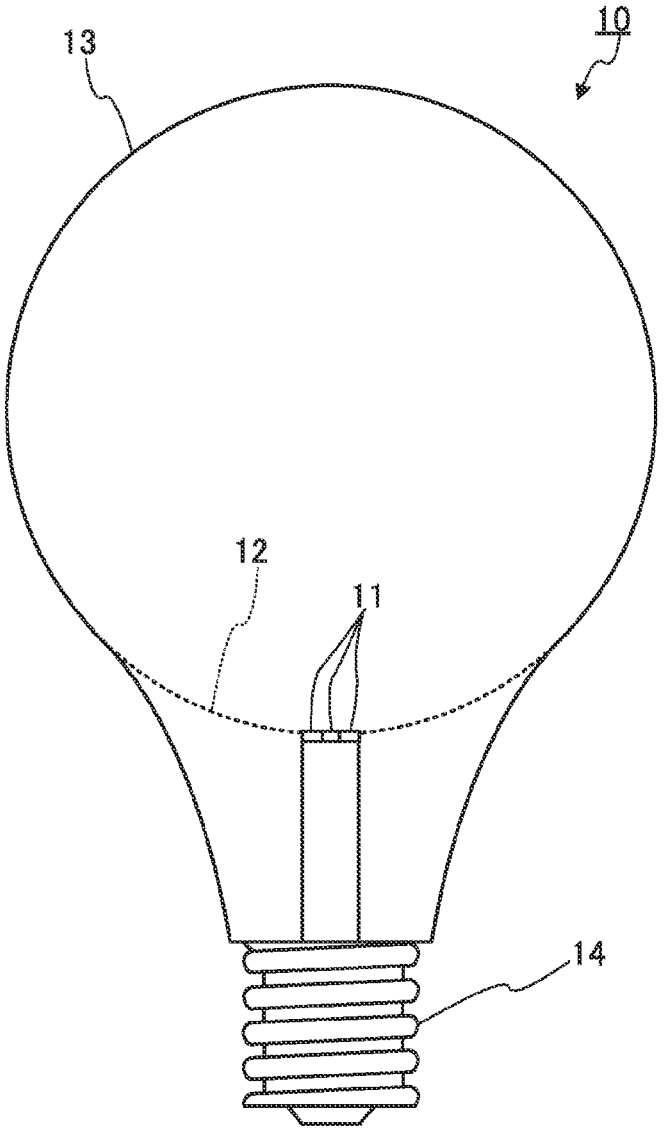
PRIOR ART FIG. 1
FIG. 1 is a schematic view illustrating a configuration of a lighting device disclosed in PTL 1.
Figure 2:
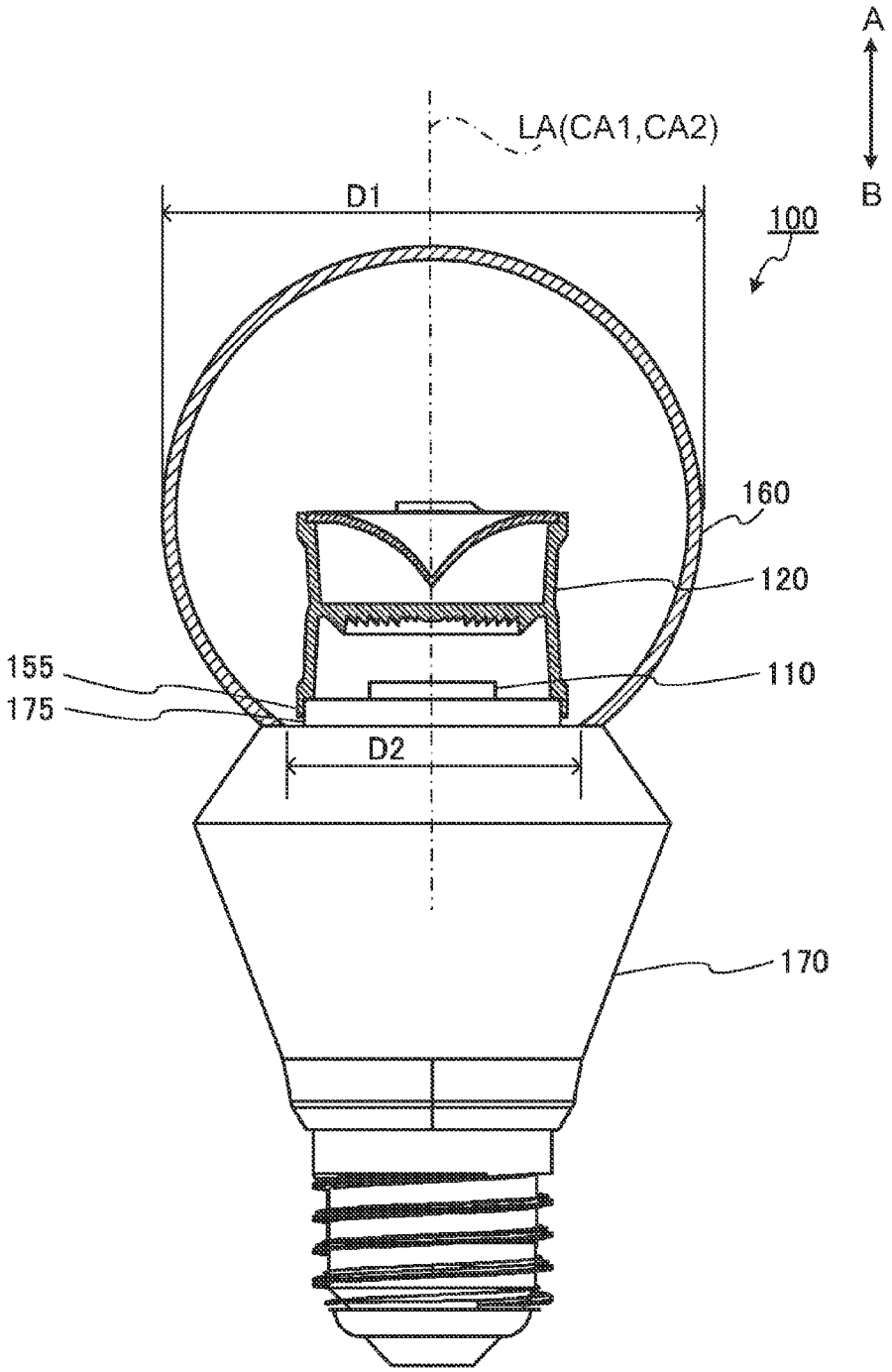
FIG. 2 is a cross-sectional view of a main portion of a lighting device according to Embodiment 1 of the present invention.

FIG. 2 is a cross-sectional view illustrating a configuration of a lighting device according to Embodiment 1 of the present invention. As illustrated in FIG. 2, lighting device 100 has light emitting element 110, light flux controlling member 120, cover 160 and housing 170. Hereinafter, each configuring element will be described.

(1) Light Emitting Element

Light emitting element 110 is a light source of lighting device 100 and is mounted on housing 170. For example, light emitting element 110 is a light emitting diode (LED) such as a white light emitting diode. The number of light emitting elements 110 may be one or more. The term "optical axis of the light emitting element" means a travelling direction of light at the center of a three-dimensional light flux from the light emitting element. If two or more light emitting elements are provided, the term means the travelling direction of the light at the center of three-dimensional light flux from two or more light emitting elements. Hereinafter, an emitting direction along optical axis LA of light emitting element 110, that is, a forward direction of lighting device 100, (direction A illustrated in FIG. 2) is referred to as a front side, and the opposite direction thereof, that is, a rear direction of lighting device 100, (direction B illustrated in FIG. 2) is referred to as a rear side.

(2) Light Flux Controlling Member

Figure 3:
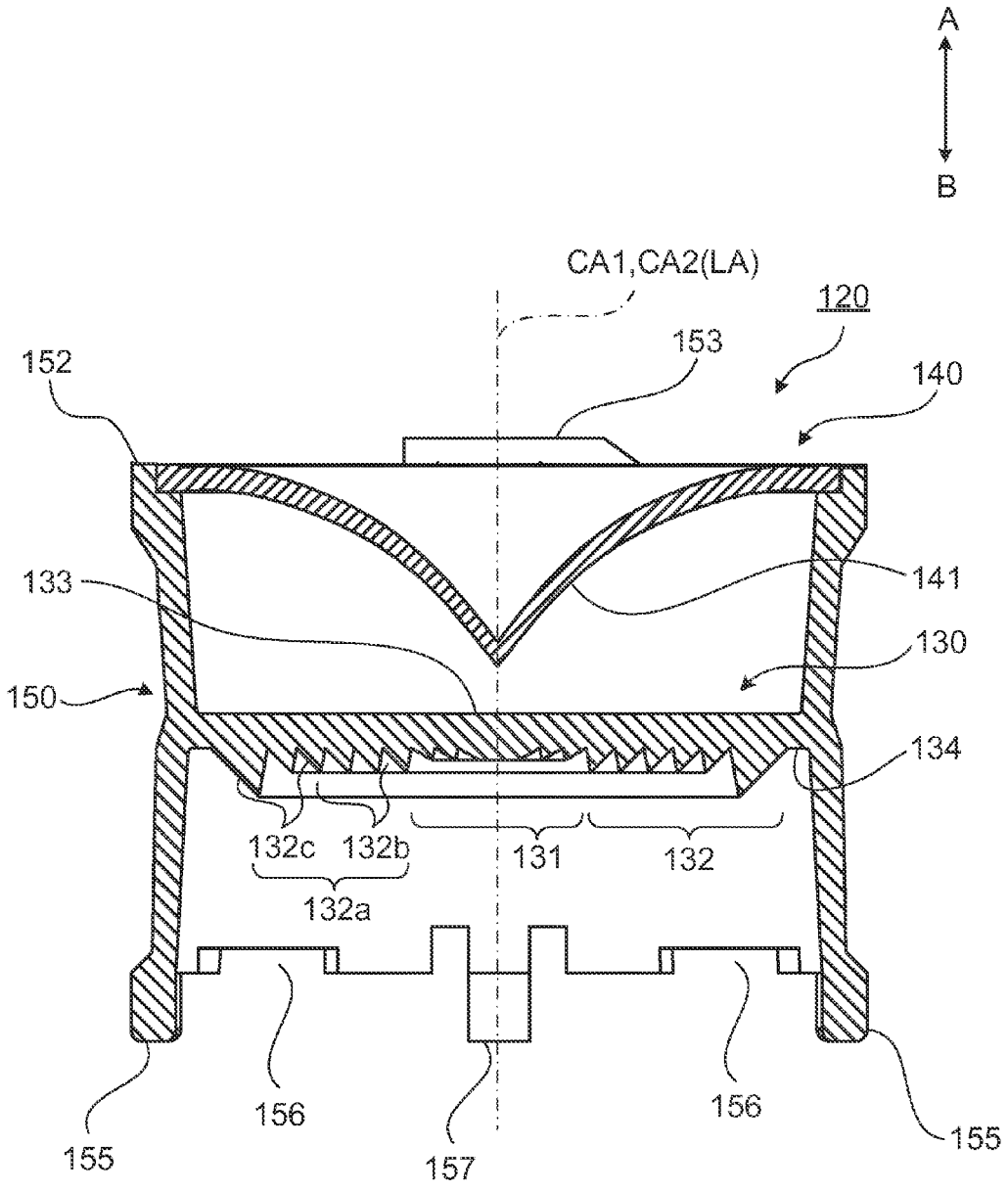
FIG. 3 is a cross-sectional view of a light flux controlling member according to Embodiment 1.

FIG. 3 is a cross-sectional view of light flux controlling member 120. As illustrated in FIG. 3, light flux controlling member 120 has first light flux controlling member 130, second light flux controlling member 140 and holder 150. Second light flux controlling member 140 is arranged on a front end of holder 150, and first light flux controlling member 130 is arranged at a central portion of holder 150. First light flux controlling member 130 opposes light emitting element 110, and second light flux controlling member 140 opposes first light flux controlling member 130. Any one of central axis CA1 of first light flux controlling member 130, central axis CA2 of second light flux controlling member 140 and the central axis of holder 150 coincides with optical axis LA. In this manner, light flux controlling member 120 is arranged on optical axis LA.

(2-1) First Light Flux Controlling Member

Figure 4A:
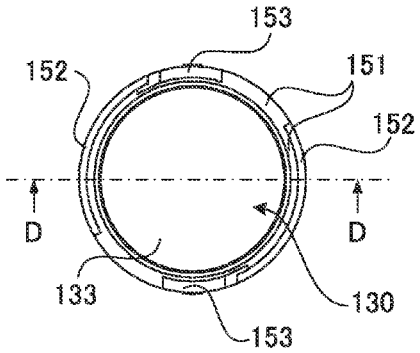
FIG. 4A is a plan view of a first light flux controlling member and a holder according to Embodiment 1.
Figure 4B:
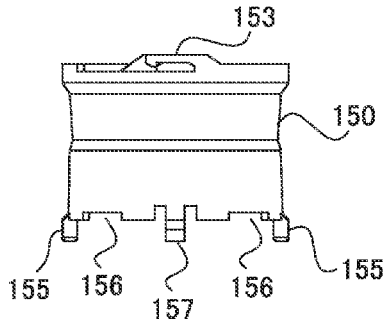
FIG. 4B is a side view of the first light flux controlling member and the holder.
Figure 4D:
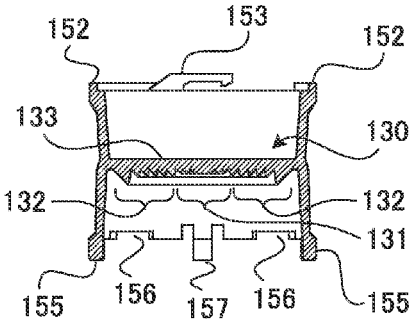
FIG. 4D is a cross-sectional view of the first light flux controlling member and the holder along a line D-D illustrated in FIG. 4A.
Figure 4C:
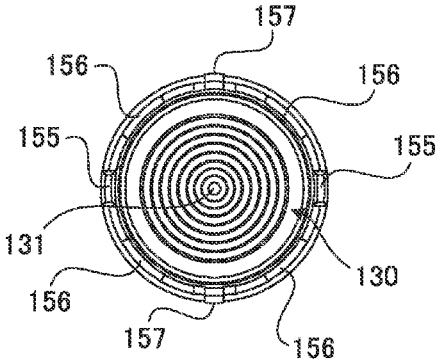
FIG. 4C is a bottom view of the first light flux controlling member and the holder.

FIGS. 4A to 4D are views illustrating configurations of first light flux controlling member 130 and holder 150. FIG. 4A is a plan view of first light flux controlling member 130 and holder 150. FIG. 4B is a side view of first light flux controlling member 130 and holder 150. FIG. 4C is a bottom view of first light flux controlling member 130 and holder 150. FIG. 4D is a cross-sectional view of first light flux controlling member 130 and holder 150 along the line D-D illustrated in FIG. 4A.

As illustrated in FIG. 4A, first light flux controlling member 130 is formed so that a shape when viewed in a plan view is a substantially circular shape. First light flux controlling member 130 is formed integrally with holder 150, and is arranged with respect to light emitting element 110 via an air layer (refer to FIG. 2). As illustrated in FIGS. 3 and 4D, first light flux controlling member 130 has refraction portion 131, Fresnel lens section 132 and emission surface 133.

Refraction portion 131 is formed at the central portion on a rear side surface of first light flux controlling member 130. Refraction portion 131 has a rotationally symmetric-shaped surface whose rotation axis is central axis CA1, and for example, the shape thereof in a plan view is circular. For example, refraction portion 131 is configured to have a planar, a spherical, an aspherical or a refractive Fresnel lens, or a combination thereof. Refraction portion 131 refracts a part of light which is emitted from light emitting element 110 and is incident on refraction portion 131 toward the emission surface 133. Refraction portion 131 functions as an incidence surface of the light on which a part of the light emitted from light emitting element 110 is incident.

Fresnel lens section 132 is formed around refraction portion 131 on a rear side surface of first light flux controlling member 130. Fresnel lens section 132 has a plurality of annular projections 132*a* which are arranged concentrically.

Annular projections 132*a* each have first inclined surface 132*b* positioned inside and second inclined surface 132*c* positioned outside.

First inclined surface 132*b* is a surface extending from a top edge of annular projection 132*a* to a bottom edge inside annular projection 132*a*, and is a rotationally symmetric surface whose rotation axis is central axis CA1 of first light flux controlling member 130. That is, first inclined surface 132*b* is formed in an annular shape whose rotation axis is central axis CA1. Inclination angles of first inclined surface 132*b* with respect to central axis CA1 may be different from each other. In addition, first inclined surface 132*b* may be parallel with central axis CA1 (inclination angle 90°). Furthermore, a generating line of first inclined surface 132*b* may be a straight line, or may be a curve.

The term "generating line" generally means a straight line to draw a ruled surface, but in the present invention, is used as a term also including a curve to draw a rotationally symmetric surface. The inclination angle of first inclined surface 132*b* when first inclined surface 132*b* is a curved surface is an angle of a tangent of first inclined surface 132*b* with respect to central axis CA1. First inclined surface 132*b* functions as an incidence surface of light on which a part of the light emitted from light emitting element 110 is incident.

Second inclined surface 132*c* is a surface extending from a top edge of annular projection 132*a* to a bottom edge outside annular projection 132*a*. Second inclined surface 132*c* is a rotationally symmetric surface whose rotation axis is central axis CA1 of first light flux controlling member 130. A distance from central axis CA1 to second inclined surface 132*c* is gradually increased from the top edge of annular projection 132*a* toward the bottom edge. The generating line configuring second inclined surface 132*c* is an arc-shaped curve which is convex outward (side away from ventral axis CA1). For example, depending on light distribution characteristics required for lighting device 100, the generating line configuring second inclined surface 132*c* may be a straight line. That is, second inclined surface 132*c* may be a tapered surface.

The inclination angles of second inclined surface 132*c* with respect to central axis CA1 may be different from each other for each of second inclined surfaces 132*c*. The inclination angle of second inclined surface 132*c* when second inclined surface 132*c* is a curved surface is an angle of the tangent of second inclined surface 132*c* with respect to central axis CA1. Flange 134 is disposed between an outer edge of outermost second inclined surface 132*c* and an inner surface of holder 150. Flange 134 may not be disposed.

Second inclined surface 132*c* totally reflects a part of light incident on first inclined surface 132*b* toward second light flux controlling member 140. Second inclined surface 132*c* functions as a total reflection surface which totally reflects a part of light which is incident from first inclined surface 132*b*. That is, Fresnel lens section 132 functions as a reflection type Fresnel lens.

Emission surface 133 configures a front side surface of first light flux controlling member 130. That is, emission surface 133 opposes second light flux controlling member 140. Emission surface 133 emits a part of light which is incident from refraction portion 131 and first inclined surface 132*b* and light which is totally reflected on second inclined surface 132*c*, toward second light flux controlling member 140.

A material of first light flux controlling member 130 is not particularly limited as long as the material has high transparency which allows light of a desired wavelength to pass therethrough. For example, the material of first light flux controlling member 130 is a light-transmitting resin such as polymethyl methacrylate (PMMA), polycarbonate (PC) and epoxy resin (EP), or glass. For example, first light flux controlling member 130 is formed by injection molding.

First light flux controlling member 130 controls a travelling direction of a part of light emitted from light emitting element 110. More specifically, first light flux controlling member 130 emits a part of light which is emitted from light emitting element 110 and reaches first light flux controlling member 130, toward second light flux controlling member 140. In this manner, first light flux controlling member 130 functions so that light distribution of light emitted from first light flux controlling member 130 is narrower than light distribution of the light emitted from light emitting element 110.

(2-2) Second Light Flux Controlling Member

Figure 5A:
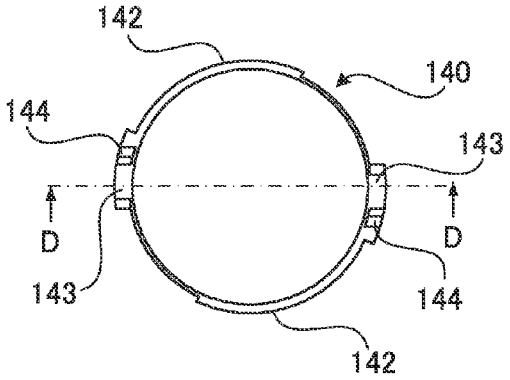
FIG. 5A is a plan view of a second light flux controlling member according to Embodiment 1.
Figure 5B:
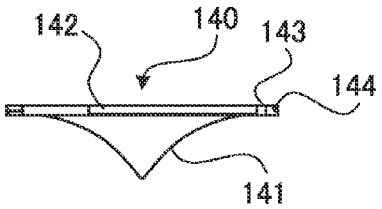
FIG. 5B is a side view of the second light flux controlling member.
Figure 5D:
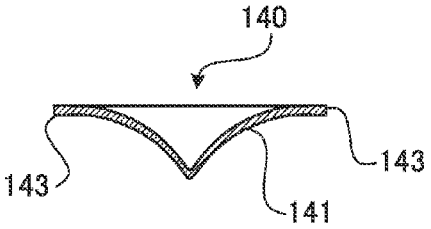
FIG. 5D is a cross-sectional view of the second light flux controlling member along the line D-D illustrated in FIG. 5A.
Figure 5C:
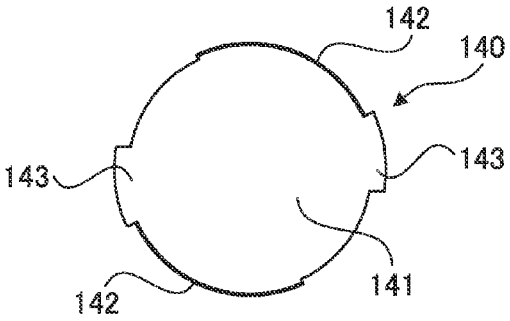
FIG. 5C is a bottom view of the second light flux controlling member.

FIGS. 5A to 5D are views illustrating a configuration of second light flux controlling member 140. FIG. 5A is a plan view of second light flux controlling member 140, FIG. 5B is a side view of second light flux controlling member 140, FIG. 5C is a bottom view of second light flux controlling member 140, and FIG. 5D is a cross-sectional view of second light flux controlling member 140 along the line D-D illustrated in FIG. 5A. As illustrated in FIG. 5A, second light flux controlling member 140 is formed in a substantially circular shape in a plan view. Second light flux controlling member 140 is arranged with respect to first light flux controlling member 130 via an air layer (refer to FIG. 3). Second light flux controlling member 140 has reflection surface 141. Reflection surface 141 faces to first light flux controlling member 130.

Reflection surface 141 is a rotationally symmetric (circularly symmetric) surface whose rotation axis is central axis CA2 of second light flux controlling member 140. A generating line from the center of the rotationally symmetric surface to the outer peripheral portion is a curve which is concave toward light emitting element 110 and first light flux controlling member 130. Reflection surface 141 is a curved surface formed in case where the generating line is rotated 360°. That is, reflection surface 141 has an aspherically-shaped curved surface in which a height from light emitting element 110 in a direction of optical axis LA is increased from the center toward the outer peripheral portion.

The outer peripheral portion of reflection surface 141 is formed at a farther position away from light emitting element 110 in the direction of optical axis LA of light emitting element 110, compared to the center of reflection surface 141. For example, reflection surface 141 is the aspherical-shaped curved surface in which a distance from light emitting element 110 is increased from the center toward the outer peripheral portion. In this case, an angle of reflection surface 141 with respect to central axis CA2 is increased from the center toward the outer peripheral portion.

Alternatively, reflection surface 141 may be the aspherical-shaped curved surface in which: a distance to light emitting element 110 in the direction of central axis CA2 is increased from the central portion toward the outer peripheral portion in an area from the central portion to a predetermined point; and, a distance to light emitting element 110 is decreased from the central portion toward the outer peripheral portion in an area from the predetermined point to the outer peripheral portion. In this case, a point whose angle with respect to central axis CA2 is 90° is present close to the outer peripheral portion, between the central portion and the outer peripheral portion on the reflection surface 141.

It is preferable that reflection surface 141 be formed so that reflection intensity of incident light in a regular reflection direction is greater than reflection intensity of incident light in the other direction. Therefore, it is preferable that a surface of second light flux controlling member 140 which opposes first light flux controlling member 130 be a glossy surface.

Second light flux controlling member 140 further includes flange 142 surrounding the further outside of the outer peripheral portion of reflection surface 141, fitting portion 143 formed at an end portion of flange 142 in the circumferential direction and protruding further outward from flange 142, and recess 144 formed in fitting portion 143.

Second light flux controlling member 140 has a function of partial reflection and partial transmission. Means for providing second light flux controlling member 140 with such a function of the partial reflection and the partial transmission is not particularly limited.

For example, the above-described function can be provided for second light flux controlling member 140 by forming a transmission reflection film on a rear side surface of second light flux controlling member 140 formed of a light-transmitting material. An example of the light-transmitting material includes a transparent resin material such as polymethyl methacrylate (PMMA), polycarbonate (PC) and epoxy resin (EP), or glass. An example of the transmission reflection film includes a dielectric multilayer film such as a multilayer film of $TiO_2$ and $SiO_2$, a multilayer film of $ZrO_2$ and $SiO_2$ and a multilayer film $Ta_2O_5$ and $SiO_2$, and a thin metal film made of aluminum (Al) or the like.

In addition, the above-described function can be provided for second light flux controlling member 140 by diffusing scattered particles such as beads inside second light flux controlling member 140 formed of a light-transmitting material. That is, second light flux controlling member 140 may be formed of a material which reflects a part of light and transmits a part of the light.

Further, the above-described function can be provided for second light flux controlling member 140 by forming a light-transmitting portion in second light flux controlling member 140 formed of a light-reflecting material if necessary. An example of the light-reflecting material includes a white resin or metal. An example of the light-transmitting portion includes a through-hole or a bottomed-recess. In a case of the latter, the light emitted from light emitting element 110 and first light flux controlling member 130 is transmitted through a bottom portion of the recess (portion where the thickness is thinner). For example, it is possible to manufacture second light flux controlling member 140 which has both light-reflecting and light-transmitting functions by using white polymethyl methacrylate whose light-transmitting transmittance of visible light is approximately 20% and whose reflectance is approximately 80%.

Second light flux controlling member 140 controls a travelling direction of the light emitted from emission surface 133 of first light flux controlling member 130. Second light flux controlling member 140 functions so as to transmit a part of the light emitted from first light flux controlling member 130 and emit the light a forward direction and a lateral direction of lighting device 100, and so as to reflect and emit the remaining part of the light emitted from first light flux controlling member 130 a lateral direction and a rear direction of lighting device 100.

With regard to a light emitting direction in the specification, the term "forward direction" may also mean a front side in the direction of optical axis LA, that is, a direction in which an emission angle is 0°. The term "lateral direction" may also mean a direction in which the emission angle is greater than 0° and equal to or smaller than 90°. The term "rear direction" may also mean a direction in which the emission angle is greater than 90° and equal to or smaller than 180°.

Reflection surface 141 reflects light which reaches reflection surface 141 toward the lateral direction and the rear direction. The light which reaches a position closer to the center of reflection surface 141 is reflected more forwardly than the light which reaches a position closer to an outer peripheral edge of reflection surface 141. The light emitted toward the rear direction from light flux controlling member 120 is mainly the light reflected on the outer peripheral portion of reflection surface 141. The light emitted toward the rear direction from light flux controlling member 120 is mainly emitted from an upper half portion of the outer peripheral surface of holder 150 in FIG. 2 (further forward side portion than first light flux controlling member 130).

(2-3) Holder

Holder 150 has a light-transmitting function. A material of holder 150 is not particularly limited as long as the material allows light of a desired wavelength to pass therethrough. For example, the material of holder 150 is a light-transmitting resin such as polymethyl methacrylate (PMMA), polycarbonate (PC) and epoxy resin (EP), or glass.

As illustrated in FIGS. 3 and 4A to 4D, holder 150 is formed in a rotationally symmetric cylindrical shape whose rotation axis is central axis CA1. For example, holder 150 is formed in a substantially cylindrical shape. Holder 150 is formed by molding integrally with first light flux controlling member 130 arranged in a central portion thereof.

Holder 150 has a structure for fixing second light flux controlling member 140 at a front side end portion. For example, holder 150 has guide projections 152 and pawls 153 on end surface 151 of the front side of holder 150. End surface 151 is formed over the entire inside circumference of the front side end portion of holder 150.

The number of guide projections 152 is not particularly limited, but is generally two or more. For example, as illustrated in FIGS. 4A to 4D, holder 150 has two guide projections 152 which oppose each other. A shape of guide projection 152 is not particularly limited as long as guide projection 152 can be fitted to second light flux controlling member 140 in a radial direction of holder 150. For example, the shape of guide projection 152 in a plan view is a circular arc shape as illustrated in FIGS. 4A to 4D.

The number of pawls 153 is not particularly limited, but is generally two or more. For example, as illustrated in FIGS. 4A to 4D, holder 150 has two pawls 153 which oppose each other. In addition, a shape of pawl 153 is not particularly limited as long as pawl 153 can be fitted to recess 144 of second light flux controlling member 140 when second light flux controlling member 140 is rotated.

In addition, holder 150 has a structure for positioning holder 150 with respect to housing 170 at a rear side end portion of holder 150. For example, at the rear side end portion of holder 150, holder 150 has boss 155 for positioning holder 150 on housing 170, vent 156 for ventilating air around first light flux controlling member 130, and locking pawl 157 which locks into a locking hole (not illustrated) formed in an upper surface of housing 170.

In a case of providing a light diffusing function to holder 150, scattered particles may be included in the above-described light-transmitting material, or a surface of holder 150 may be subjected to light diffusion processing.

Light flux controlling member 120 is manufactured by assembling second light flux controlling member 140 with an integrally molded product of first light flux controlling member 130 and holder 150. For example, the integrally molded product of first light flux controlling member 130 and holder 150 can be manufactured through injection molding by using colorless and transparent resin materials. For example, second light flux controlling member 140 can be manufactured by depositing a transparent reflection film on a surface serving as a reflection surface 141 after injection molding with the colorless and transparent resin materials, or by injection molding with a white resin material.

Second light flux controlling member 140 is fixed to a front side end portion of holder 150 in such a manner that flange 142 and fitting portion 143 are placed on end surface 151 and are rotated in this state. Guide projection 152 comes into contact with an outer peripheral surface of flange 142, thereby preventing second light flux controlling member 140 from moving in a radial direction of holder 150. Pawl 153 locks into recess 144, thereby preventing second light flux controlling member 140 from being released and rotated.

Flange 142 comes into contact with an entire circumference of end surface 151, thereby preventing light from leaking from a gap between second light flux controlling member 140 and holder 150. When second light flux controlling member 140 is assembled, an adhesive may be used. Holder 150 is positioned on housing 170, and positions first light flux controlling member 130 and second light flux controlling member 140 with respect to light emitting element 110.

Light flux controlling member 120 may be manufactured by separately forming first light flux controlling member 130 and holder 150 and by assembling first light controlling member 130 and second light flux controlling member 140 with holder 150. A degree of freedom is improved in selecting a material for forming holder 150 and first light flux controlling member 130 by separately forming first light flux controlling member 130 and holder 150. For example, light flux controlling member 120 having holder 150 made of a light-transmitting material including the scattered particles and first light flux controlling member 130 made of light-transmitting material excluding the scattered particles can be easily prepared.

(3) Cover

Cover 160 has an opening. Cover 160 forms a hollow cavity area. Light flux controlling member 120 is arranged inside the hollow cavity area of cover 160.

Cover 160 has a light-transmitting function. For example, the material of cover 160 is a light-transmitting resin such as polymethyl methacrylate (PMMA), polycarbonate (PC) and epoxy resin (EP), or glass. Cover 160 also has light diffusion. Means for providing light diffusion for cover 160 is not particularly limited. For example, an inner surface or an outer surface of cover 160 made of a transparent material may be subjected to light diffusion processing (for example, surface roughening processing), or cover 160 may be made of a material prepared by mixing a light diffusion material including the scattered particles such as beads with the above-described transparent material.

For example, an outer surface or an inner surface of cover 160 may be smooth or may be roughened. Irregularities in illuminance of lighting device 100 can be decreased by roughening the outer surface or the inner surface of cover 160.

In general, it is preferable that cover 160 have a rotationally symmetric shape with respect to optical axis LA. For example, a shape of cover 160 may be a shape formed only from the rotationally symmetric shape, or may be a shape including a portion of the rotationally symmetric shape. It is preferable that the shape of cover 160 be a shape which can further improve a balance of light distribution of light emitted from light flux controlling member 120.

For example, from a viewpoint of further increasing an amount of light toward the rear direction of lighting device 100, it is preferable that the shape of cover 160 have a smaller diameter of the cover opening than a maximum outer diameter of cover 160. For example, the shape of cover 160 is a spherical crown shape (portion of a spherical surface is cut out in a plane). A maximum outer diameter D1 of cover 160 is 60 mm, for example. An opening diameter D2 of cover 160 is 38 mm, for example (refer to FIG. 2).

Cover 160 covers light flux controlling member 120, and diffuses and transmits light emitted from light flux controlling member 120.

(4) Housing

Figure 6:
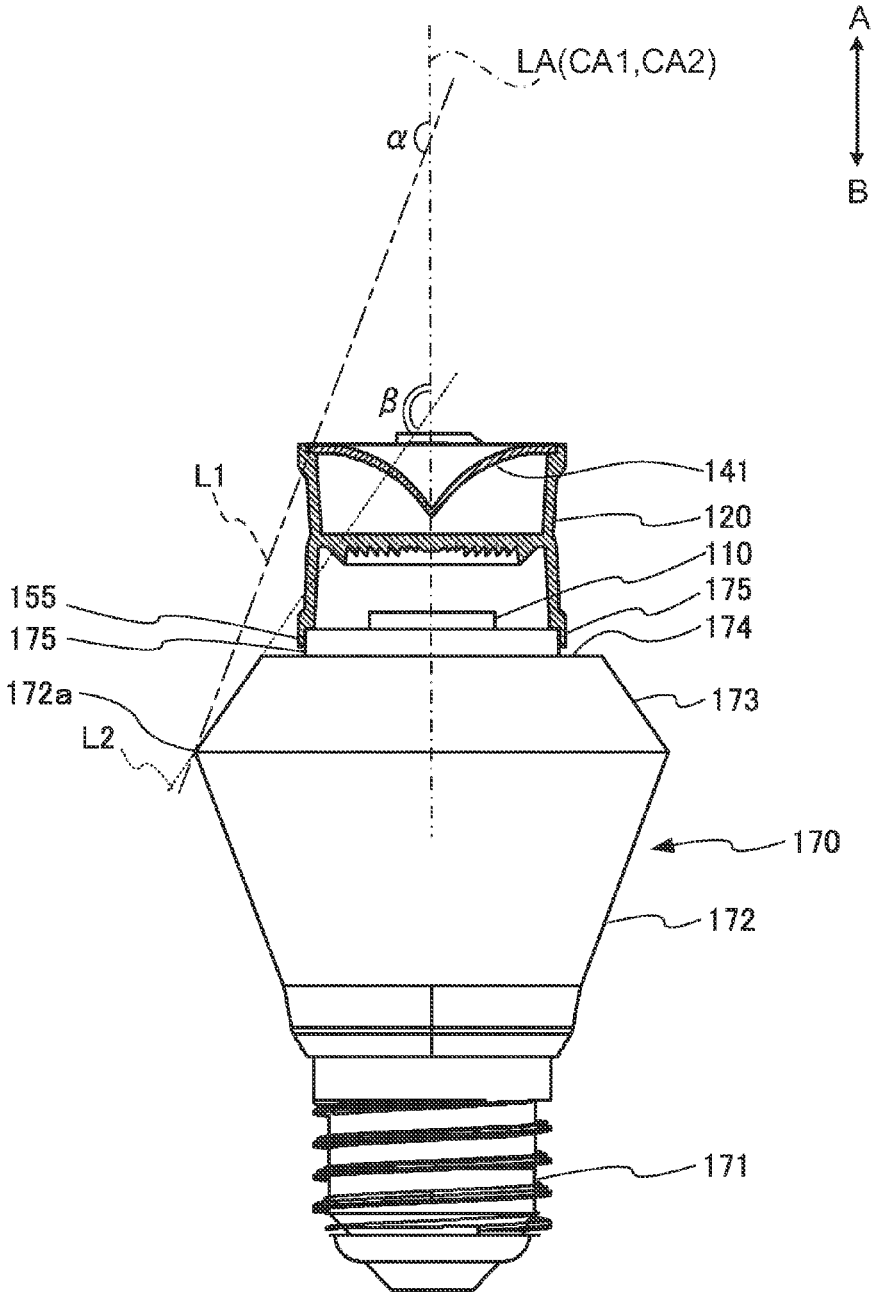
FIG. 6 is a view for explaining angles α and β in the lighting device according to Embodiment 1.

Housing 170 supports light emitting element 110, light flux controlling member 120 and cover 160 respectively at the front end portion of housing 170. Housing 170 is formed in a rotationally symmetric body whose rotation axis is optical axis LA. As illustrated in FIG. 6, housing 170 includes Edison screw 171, first tapered surface 172 which is arranged in front of Edison screw 171 wherein a distance from optical axis LA to first tapered surface 172 is gradually increased toward the forward direction, second tapered surface 173 in which a distance from optical axis LA to second tapered surface 173 is gradually decreased toward the forward direction from front end edge 172*a* of first tapered surface 172, annular end surface 174 which is formed inside of the front end edge of second tapered surface 173 and is configured in an annular plane perpendicular to optical axis LA, and cylindrical protruding portion 175 protruding forward from an inner peripheral edge of annular end surface 174.

Light emitting element 110 is mounted on a circular front end surface of protruding portion 175. As illustrated in FIG. 2, boss 155 of light flux controlling member 120 comes into contact with a front end peripheral portion of protruding portion 175 from outside. A distance from annular end surface 174 to a front end surface of protruding portion 175 (protruding length of protruding portion 175) in the direction of optical axis LA is 3 mm, for example. The opening of cover 160 is in contact with annular end surface 174. An outer diameter of annular end surface 174 is substantially the same as a diameter of the opening of cover 160. Annular end surface 174 is a pedestal with which the opening of cover 160 comes into contact. Second tapered surface 173 is a tapered surface in which a distance from optical axis LA to second tapered surface 173 is gradually increased toward the rear direction from a peripheral edge of the pedestal.

A power supply circuit (not illustrated) which electrically connects Edison screw 171 and light emitting element 110 is arranged in an inside area surrounded by first tapered surface 172 and second tapered surface 173 of housing 170. In addition, housing 170 also serves as a heat sink for radiating heat generated from light emitting element 110. Therefore, housing 170 is made of a metal having high thermal conductivity such as aluminum and copper.

The shape of housing 170 is determined depending on light distribution characteristics of light flux controlling member 120. Herein, the light distribution characteristics of light flux controlling member 120 will be described. First, an optical path of light in light flux controlling member 120 will be described.

The light being incident at a small angle with respect to optical axis LA of light emitting element 110 is incident on first light flux controlling member 130 from refraction portion 131, and is emitted from emission surface 133, and reaches second light flux controlling member 140. The light being incident at a large angle with respect to optical axis LA of light emitting element 110 is incident on first inclined surface 132*b* of first light flux controlling member 130, and is reflected on second inclined surface 132*c* toward second light flux controlling member 140, and is emitted from emission surface 133, and reaches second light flux controlling member 140.

A part of the light which reaches second light flux controlling member 140 passes through second light flux controlling member 140 and reaches an upper portion of cover 160. The remaining part of the light which reaches second light flux controlling member 140 is reflected on reflection surface 141 of second light flux controlling member 140, and reaches holder 150, and is emitted from an outer peripheral surface of holder 150, and reaches a middle portion (side portion) and a lower portion of cover 160. The light reflected on a central portion of second light flux controlling member 140 is emitted toward the middle portion of cover 160, and the light reflected on an outer peripheral portion of second light flux controlling member 140 is emitted toward the lower portion of cover 160.

Figure 7:
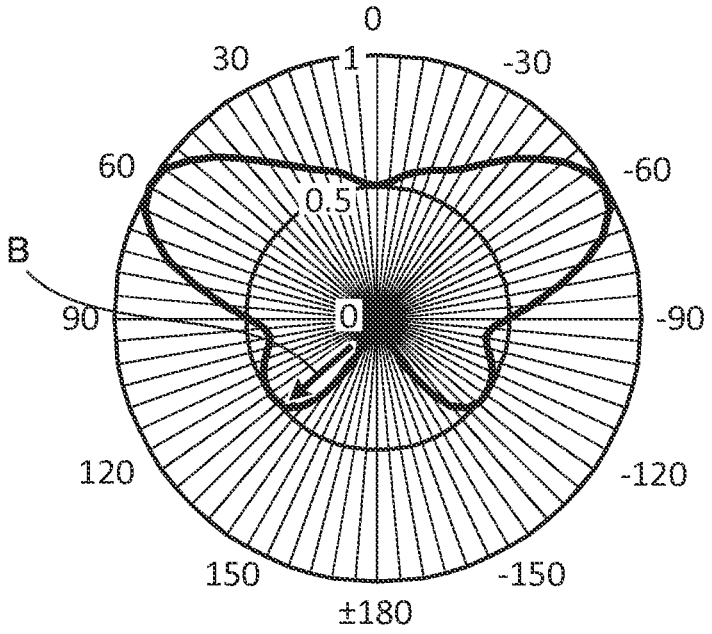
FIG. 7 is a graph illustrating light distribution of the light flux controlling member according to Embodiment 1 by using a relative value of luminous intensity.

FIG. 7 is a view illustrating light distribution of the light emitted from light flux controlling member 120 by using a relative value of luminous intensity. In FIG. 7, the terms "0°" and "±180°" mean an orientation of optical axis LA. The term "0°" means the front direction. An angle oriented further to the left side than optical axis LA with respect to the front direction is indicated by "+", and an angle of a further right side orientation is indicated by "−". The luminous intensity is approximately equal to illuminance at a distance of 1 m from a light source. The light emitted from light emitting element 110 is distributed toward the forward direction, the lateral direction and the rear direction by light flux controlling member 120. In particular, as illustrated in FIG. 7, the light is distributed to have peaks at a lateral area) (±60° and peaks at a rear area (±120° to ±150°).

The term "peak" of the light emitted toward the rear direction is an apex of a portion of a light distribution characteristic curve which is shaped to protrude in an outer peripheral direction in the rear area. When a plurality of peaks is present in the rear area, the above-described "peak" is the largest peak. When a plurality of the largest peaks is substantially present, the above-described "peak" is a peak further rearward. When the above-described protruding shape in the rear area is not clear, the peak may be a maximum value of the luminous intensity in the rear area.

The peak in the rear area is illustrated by arrow B in FIG. 7, and an angle θ thereof is ±132°, for example. Angle θ may be a measured value, or may be a calculated value obtained by computer simulation. As illustrated in FIG. 7, the light emitted from light flux controlling member 120 at angle θ is strongest out of the light in the rear area.

Within the outer shape of housing 170, protruding portions with respect to the optical path of the light of angle θ which is emitted from light flux controlling member 120 are the front end edge of second tapered surface 173 and front end edge 172*a* of first tapered surface 172. Then, front end edge 172*a* of first tapered surface 172 protrudes to the above-described optical path further than the front end edge of second tapered surface 173.

As illustrated in FIG. 6, a position of front end edge 172*a* of first tapered surface 172 with respect to optical axis LA is determined by a position where when tangent L1 which comes into contact with front end edge 172*a* of first tapered surface 172 is drawn from an outer peripheral edge of reflection surface 141, angle α formed by tangent L1 with optical axis LA is equal to or greater than above-described angle θ of the peak of the light in the rear area. In any cross-section including optical axis LA, tangent L1 is a tangent which comes into contact with housing 170 from the outer peripheral edge of reflection surface 141, and an extension line thereof.

For both θ and α, a light emitting direction (direction A) side in optical axis LA is set to 0°. For example, α is 159.5°. For example, α is further increased by moving front end edge 172*a* of first tapered surface 172 closer to optical axis LA. In addition, α is further increased by further increasing a protruding height of protruding portion 175.

In addition, as illustrated in FIG. 6, when tangent L2 which comes into contact with second tapered surface 173 is drawn, second tapered surface 173 is formed so that angle β formed by tangent L2 with optical axis LA is equal to or greater than θ. In any cross-section including optical axis LA, tangent L2 is a straight line along second tapered surface 173.

For β, a light emitting direction (direction A) side of the light in optical axis LA is also set to 0°. For example, β is 145.2°. β indicates an angle of second tapered surface 173 with respect to optical axis LA, and for example, is further increased by moving front end edge 172*a* of first tapered surface 172 closer to optical axis LA.

(Optical Characteristics of Lighting Device)

Figure 8A:
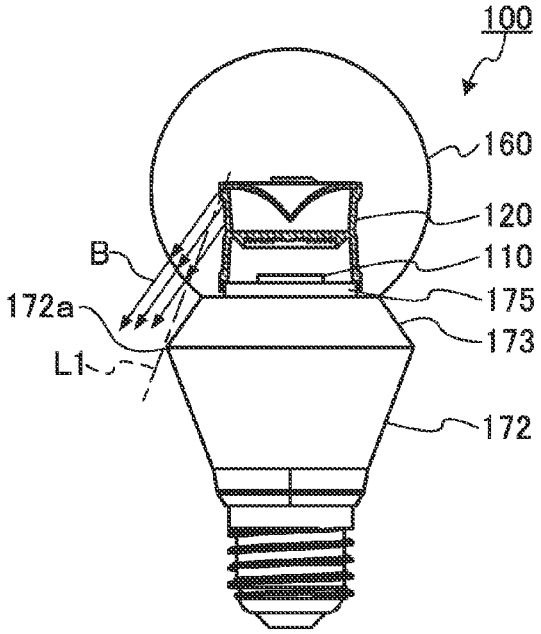
FIG. 8A is a view schematically illustrating light emitted toward a rear direction of the lighting device according to Embodiment 1.
Figure 8B:
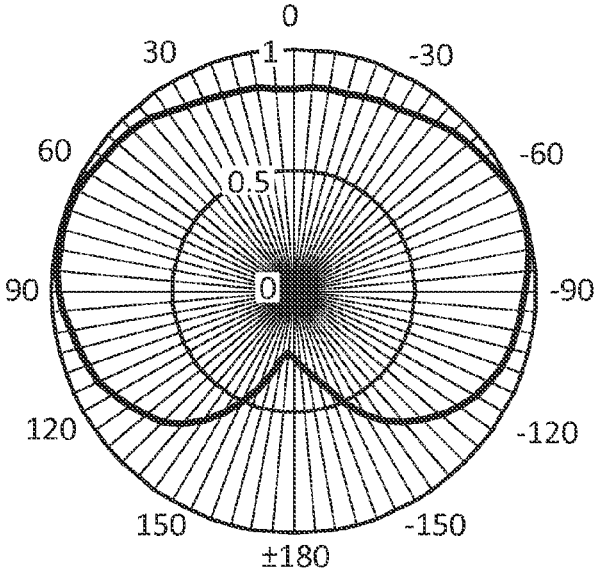
FIG. 8B is a graph illustrating the light distribution of the lighting device by using the relative value of the luminous intensity.

FIG. 8A is a view schematically illustrating light emitted toward the rear direction of lighting device 100, and FIG. 8B is a view illustrating light distribution of lighting device 100 by using a relative value of luminous intensity.

Within light emitted from light flux controlling member 120, the light emitted toward the rear direction is emitted from the outer peripheral surface of holder 150. Then, as described above, within the light emitted toward the rear direction, the strongest light emitted at angle θ (light of angle θ) is mainly emitted from a forward half of the outer peripheral surface of holder 150 (further front side portion than first light flux controlling member 130), as illustrated by arrow B in FIG. 8A. Furthermore, within the outer shape of housing 170, front end edge 172*a* of first tapered surface 172 is most protruded with respect to the optical path of the light of angle θ.

As described above, an angle formed by tangent L1 which comes into contact with front end edge 172*a* of first tapered surface 172 from the outer peripheral edge of reflection surface 141 with optical axis LA is α, and α is equal to or greater than θ. Therefore, the light reflected on the outer peripheral portion of reflection surface 141 (light of angle θ), which is main component of the light emitted toward the rear direction, travels an optical path which comes into contact with front end edge 172*a* of first tapered surface 172, or a further outer optical path, the optical path not being coming into contact with front end edge 172*a*.

Accordingly, housing 170 shaped so that α is equal to or greater than θ does not block the light of angle θ which is emitted from light flux controlling member 120. Therefore, light emitted toward the rear direction from light flux controlling member 120 at angle θ is not blocked by housing 170, is directly incident on cover 160 and is emitted from cover 160. The light emitted toward the forward direction and the lateral direction from light flux controlling member 120 is also directly incident on cover 160 and is emitted from cover 160.

In this manner, the light emitted from light flux controlling member 120 is substantially emitted toward all directions and is incident on cover 160. The light incident on cover 160 is further diffused in each orientation by cover 160, and is uniformly emitted toward all directions from cover 160. Therefore, as illustrated in FIG. 8B, the light emitted from lighting device 100 is distributed toward not only the forward direction but also the lateral direction and the rear direction with a good balance.

(Advantageous Effect)

In lighting device 100, first light flux controlling member 130 concentrates the light emitted from light emitting element 110 on second light flux controlling member 140, and second light flux controlling member 140 transmits a part of the light and reflects the remaining part toward the lateral direction and the rear direction. Then, housing 170 is formed in a shape where angle α formed by tangent L1 which comes into contact with housing 170 from the outer peripheral edge of reflection surface 141 with optical axis LA is equal to or greater than peak angle θ of the light emitted toward the rear direction. Therefore, the light emitted from light flux controlling member 120 is not blocked by housing 170, is emitted toward substantially all directions, and is directly incident on cover 160, and passes through cover 160 while being diffused, and is emitted outward. As a result, lighting device 100 can emit the light distributing toward the forward, lateral and rear directions with a good balance.

Furthermore, in lighting device 100, second tapered surface 173 is inclined at angle β which is equal to or greater than θ. Therefore, light within the light of angle θ which passes through the vicinity of the opening of cover 160 is not blocked by second tapered surface 173. As a result, an entire inner surface area of cover 160 from an apex of cover 160 to the opening can be effectively used as an incidence surface. Therefore, it is more effective from a viewpoint that cover 160 further enhances the effect in improving light distribution characteristics. In addition, since housing 170 has second tapered surface 173, the peak light toward the rear direction is not blocked. Consequently, it is also effective from a viewpoint of ensuring a sufficient capacity of housing 170.

Furthermore, in lighting device 100, cover 160 is formed in a spherical crown shape which has a smaller opening diameter than the maximum outer diameter. Therefore, it is more effective from a viewpoint of emitting the light inside cover 160 toward the rear direction and from a viewpoint of adjusting a balance in light distribution in all directions.

(Embodiment 2)

Figure 9A:
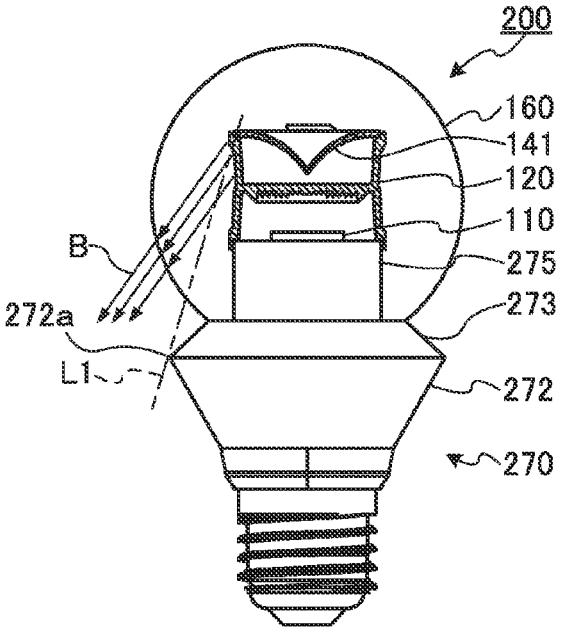
FIG. 9A is a view schematically illustrating light emitted toward a rear direction of a lighting device according to Embodiment 2.
Figure 9B:
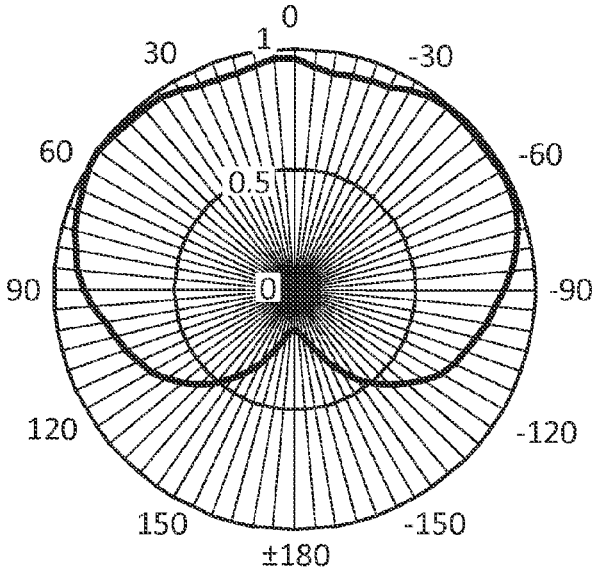
FIG. 9B is a graph illustrating the light distribution of the lighting device by using the relative value of the luminous intensity.

FIG. 9A is a view schematically illustrating light emitted toward the rear direction of lighting device 200 according to Embodiment 2, and FIG. 9B is a view illustrating light distribution of lighting device 200 by using a relative value of luminous intensity. Lighting device 200 is configured similar to lighting device 100 except for three different points of protruding portion 175, first tapered surface 172 and second tapered surface 173. The same reference numerals are given to the same configurations as for lighting device 100 and the description thereof will be omitted.

Protruding portion 275 is configured similar to protruding portion 175 except that a protruding length from an annular end surface in the direction of optical axis LA is different. The protruding length of protruding portion 275 is 15.5 mm, for example. The length of first tapered surface 272 in the direction of optical axis LA is shorter than that of first tapered surface 172. The length of second tapered surface 273 in the direction of optical axis LA is shorter than that of second tapered surface 173. It is the same as lighting device 100 in that within the outer shape of housing 270, front end edge 272*a* of first tapered surface 272 is a most protruding portion with respect to the optical path of the light of angle θ. Angle α formed by tangent L1 which passes through the outer peripheral edge of reflection surface 141 and comes into contact with front end edge 272*a* of first tapered surface 272 with optical axis LA is greater than θ. In addition, inclination angle β of second tapered surface 273 is smaller than θ.

In lighting device 200, inclination angle β of second tapered surface 273 is smaller than θ, but the protruding length of protruding portion 275 is sufficiently long. Therefore, the peak light in the rear area which is emitted from light flux controlling member 120 is not blocked by second tapered surface 273. Accordingly, as illustrated in FIG. 9B, lighting device 200 can also emit light distributing toward the forward, the lateral and the rear directions with a good balance.

Furthermore, in lighting device 200, light emitting element 110 is arranged at a central portion of a hollow region inside cover 160. Thus, a length of a portion of housing 270 from a rear end of Edison screw to the front end edge of second tapered surface 273 in the direction of optical axis LA is further shortened. Accordingly, according to the present embodiment, it is possible to configure a lighting device which has the same cover 160 as lighting device 100 and has a shorter full length than lighting device 100.

(Embodiment 3)

Figure 10A:
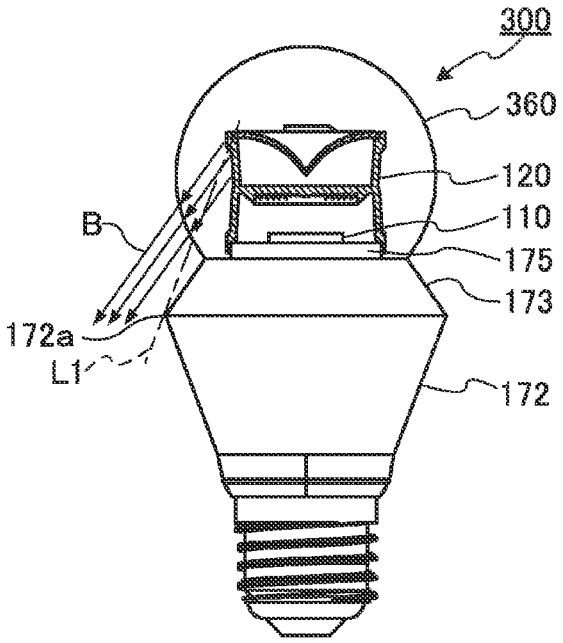
FIG. 10A is a view schematically illustrating light emitted toward a rear direction of a lighting device according to Embodiment 3.
Figure 10B:
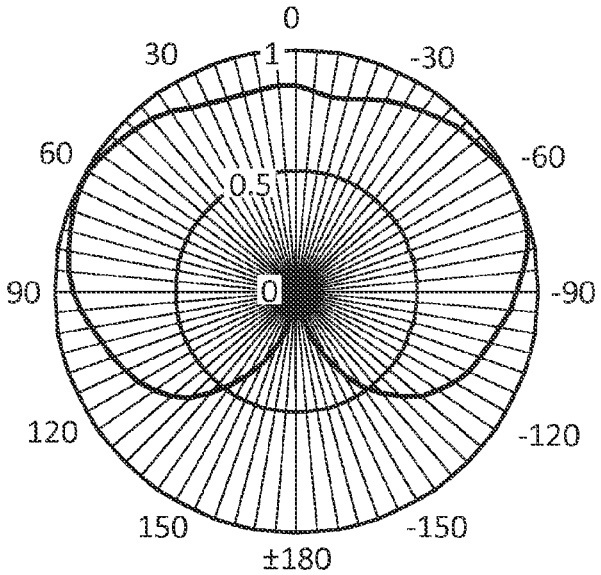
FIG. 10B is a graph illustrating the light distribution of the lighting device by using the relative value of the luminous intensity.

FIG. 10A is a view schematically illustrating light emitted toward the rear direction of lighting device 300 according to Embodiment 3, and FIG. 10B is a view illustrating light distribution of lighting device 300 by using a relative value of luminous intensity. Lighting device 300 is configured similar to lighting device 100 except that a size of cover 160 is different. The same reference numerals are given to the same configurations as for lighting device 100 and the description thereof will be omitted.

A maximum outer diameter of cover 360 is smaller than that of cover 160. The maximum outer diameter of cover 360 is 49 mm, for example. Light flux controlling member 120 and housing 170 are the same as those of lighting device 100. Thus, for the same reason as described in lighting device 100, the peak light in the rear area which is emitted from light flux controlling member 120 is not blocked by housing 170. Accordingly, as illustrated in FIG. 10B, lighting device 300 can also emit light distributing toward the forward, the lateral and the rear directions with a good balance. According to the present embodiment, it is possible to configure a lighting device which has the same housing 170 as lighting device 100 and has a shorter full-length than lighting device 100.

COMPARATIVE EXAMPLE 1

Figure 11A:
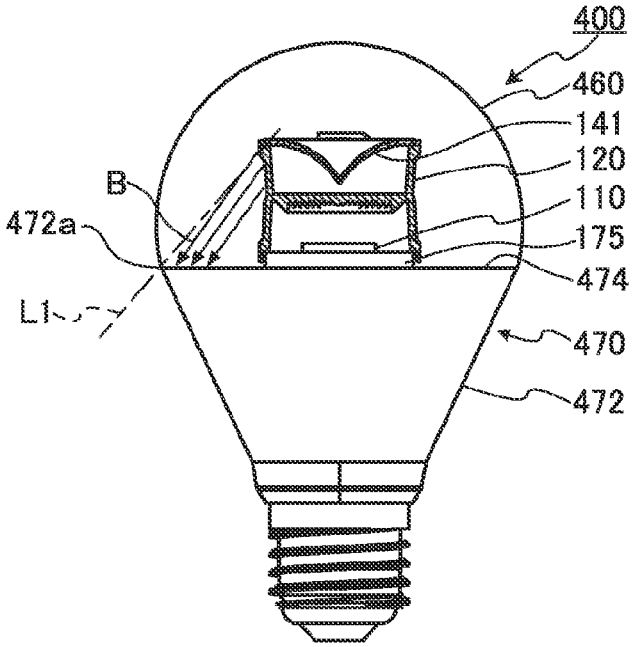
PRIOR ART FIG. 11A
FIG. 11A is a view schematically illustrating light emitted toward a rear direction of a lighting device according to Comparative Example 1.
Figure 11B:
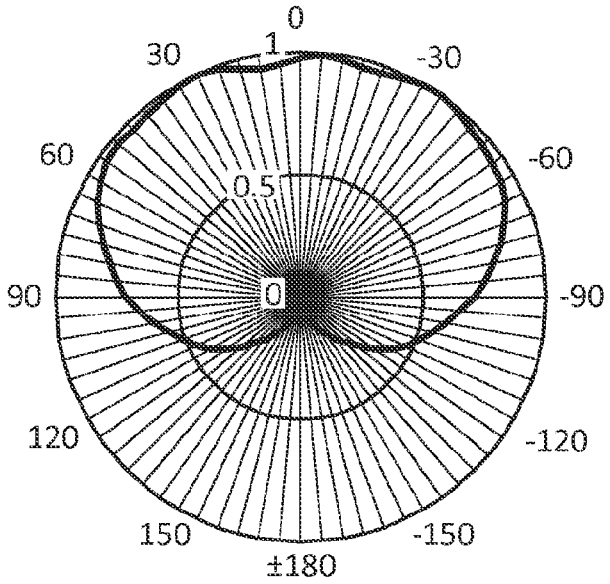
FIG. 11B is a graph illustrating the light distribution of the lighting device by using the relative value of the luminous intensity.

FIG. 11A is a view schematically illustrating light emitted toward the rear direction of lighting device 400 for comparison, and FIG. 11B is a view illustrating light distribution of lighting device 400 by using a relative value of luminous intensity. Lighting device 400 for comparison is different from lighting device 100 in a size of cover 160 and a shape of housing 170.

Housing 470 of lighting device 400 for comparison does not have second tapered surface 173. Accordingly, annular end surface 474 is formed to start from a front end edge of first tapered surface 472. In addition, both a maximum outer diameter and an opening diameter of cover 460 of lighting device 400 for comparison are larger than those of cover 160. The maximum outer diameter of cover 460 is 70 mm, for example. The opening diameter of cover 460 is 68 mm, for example. The opening of cover 460 is arranged on the outer peripheral edge of annular end surface 474, and the outer peripheral surface of cover 460 is substantially integral and continuous with the outer peripheral surface of housing 470.

In lighting device 400, annular end surface 474 protrudes outward at a smaller angle) (±90°) than angle θ of the peak light in the rear area which is emitted from light flux controlling member 120, and the opening of cover 460 is arranged in the outer peripheral edge of annular end surface 474. Then, as illustrated in FIG. 11A, angle α formed by tangent L1 which passes through the outer peripheral edge of reflection surface 141 and comes into contact with the outer peripheral edge (front end edge 472*a* of first tapered surface 472) of annular end surface 474 with optical axis LA is smaller than θ. Therefore, in lighting device 400, before reaching cover 460, the peak light in the rear area which is emitted from light flux controlling member 120 is blocked by annular end surface 474. Accordingly, as illustrated in FIG. 11B, luminous intensity in the rear in lighting device 400 is obviously lower compared to lighting devices 100 to 300.

COMPARATIVE EXAMPLE 2

Figure 12A:
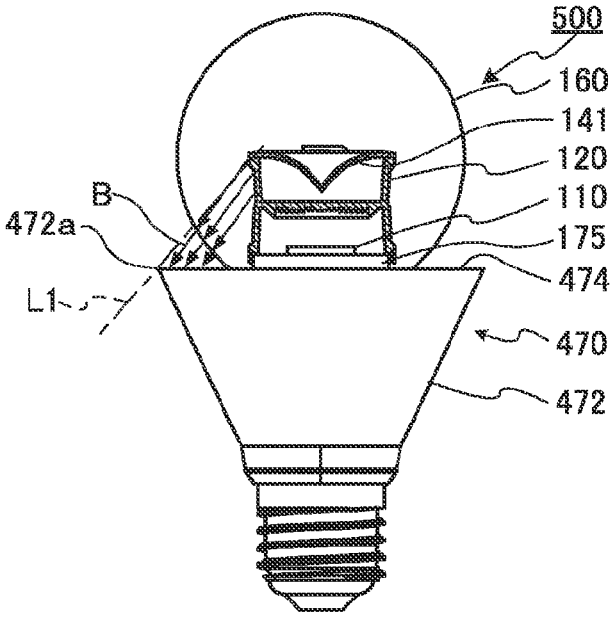
PRIOR ART FIG. 12A
FIG. 12A is a view schematically illustrating light emitted toward a rear direction of a lighting device according to Comparative Example 2.
Figure 12B:
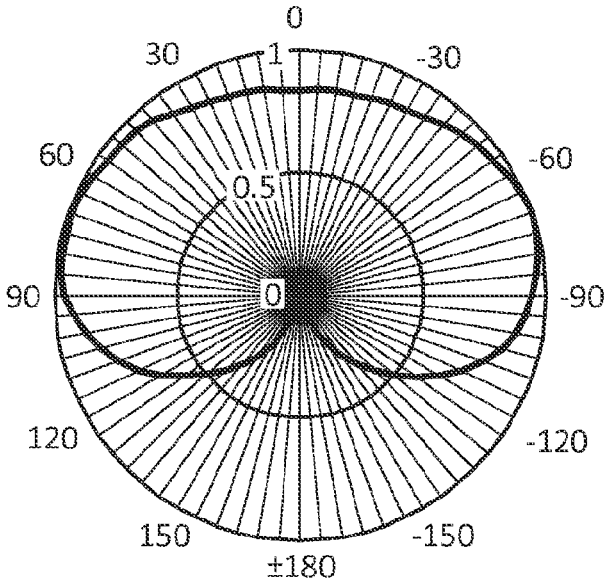
FIG. 12B is a graph illustrating the light distribution of the lighting device by using the relative value of the luminous intensity.
Figure 13A:
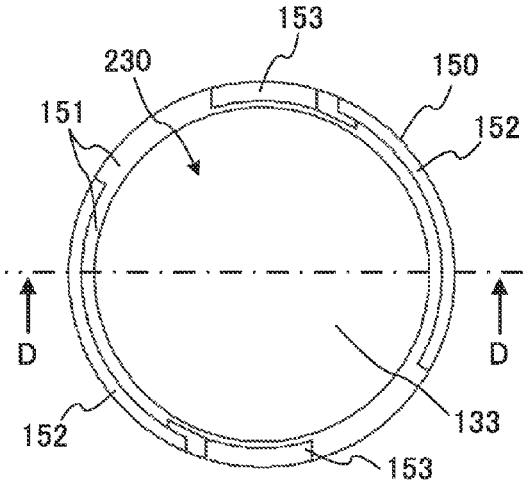
FIG. 13A is a plan view of an integrally molded product of a first light flux controlling member and a holder according a modification example of the present invention.
Figure 13B:
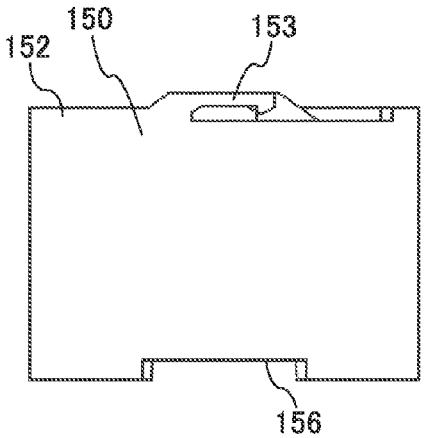
FIG. 13B is a side view of the integrally molded product.
Figure 13C:
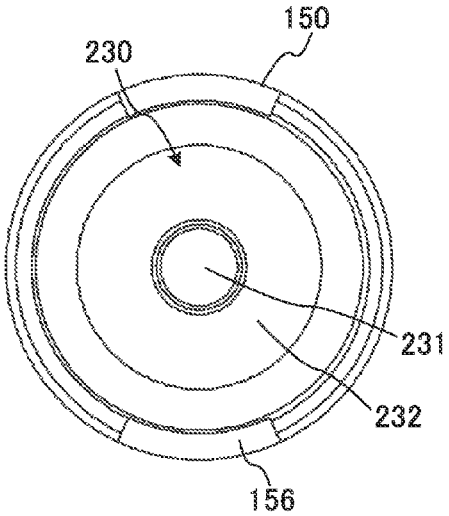
FIG. 13C is a bottom view of the integrally molded product.
Figure 13D:
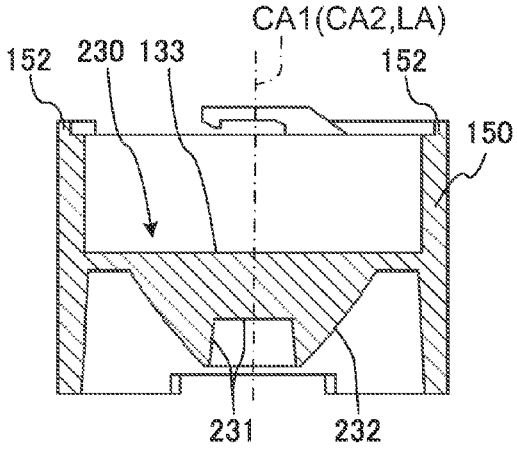
FIG. 13D is a cross-sectional view of the integrally molded product along the line D-D illustrated in FIG. 13A.

FIG. 12A is a view schematically illustrating light emitted toward the rear direction of lighting device 500 for comparison, and FIG. 12B is a view illustrating light distribution of lighting device 500 by using a relative value of luminous intensity. Lighting device 500 for comparison is configured similarly to lighting device 400 for comparison except that cover 460 is different. A cover in lighting device 500 for comparison is the same as cover 160 in lighting device 100 according to Embodiment 1 of the present invention.

The opening of cover 160 is arranged in an inner peripheral edge side of annular end surface 474, and annular end surface 474 protrudes further outward than the opening of cover 160. Then, as illustrated in FIG. 12A, angle α formed by tangent L1 which passes through the outer peripheral edge of reflection surface 141 and comes into contact with the outer peripheral edge (front end edge 472*a* of first tapered surface 472) of annular end surface 474 with optical axis LA is smaller than θ.

Therefore, in lighting device 500, the peak light in the rear area which is emitted from light flux controlling member 120 directly reaches cover 160. However, the above-described peak light which is emitted from cover 160 is blocked by annular end surface 474. Accordingly, as illustrated in FIG. 12B, luminous intensity toward the rear direction of lighting device 500 is obviously lower compared to lighting devices 100 to 300.

MODIFICATION EXAMPLE

In the present invention, instead of light flux controlling member 120, as illustrated in FIG. 13, a light flux controlling member, which has first light flux controlling member 230 excluding Fresnel lens section 132 as a first light flux controlling member, can be used. FIG. 13A is a plan view of an integrally molded product of first light flux controlling member 230 and holder 150, FIG. 13B is a side view of the integrally molded product, FIG. 13C is a bottom view of the integrally molded product, and FIG. 13D is a cross-sectional view of the integrally molded product along the line D-D illustrated in FIG. 13A. The same reference numerals are given to the same configurations as for first light flux controlling member 120 and holder 150, and the description thereof will be omitted.

First light flux controlling member 230 has incidence surface 231 on which light emitted from light emitting element 110 is incident, total reflection surface 232 which totally reflects a part of the light incident from incidence surface 231, and emission surface 133 which emits a part of the light incident from incidence surface 231 and the light reflected on total reflection surface 232.

Incidence surface 231 is an inner surface of a recess formed at a bottom portion of first light flux controlling member 230. Incidence surface 231 includes an inner upper surface configuring an upper surface of the recess and a tapered inner side surface configuring a side surface of the recess. In the inner side surface, an inner diameter is gradually increased toward the opening edge side from the inner upper surface side so that an inner diameter dimension of the opening edge side is larger than an inner diameter dimension of the edge of the inner upper surface side (refer to FIG. 13D).

Total reflection surface 232 is a surface extending from an outer edge of the bottom portion of first light flux controlling member 230 to an outer edge of emission surface 133. Total reflection surface 232 is a rotationally symmetric surface whose rotation axis is central axis CA1 of first light flux controlling member 230. The diameter of total reflection surface 232 is gradually increased from the bottom portion toward emission surface 133. The generating line configuring total reflection surface 232 is an arc-shaped curve which is convex outward (side away from central axis CA1). The generating line configuring total reflection surface 232 may be a straight line and total reflection surface 232 may have a tapered shape.

A light flux controlling member is configured by mounting second light flux controlling member 140 on the integrally molded product as described above. Instead of light flux controlling member 120, even by using the above-described light flux controlling member, it is possible to obtain a lighting device having light distribution characteristics similar to the incandescent lamp.

Figure 14A:
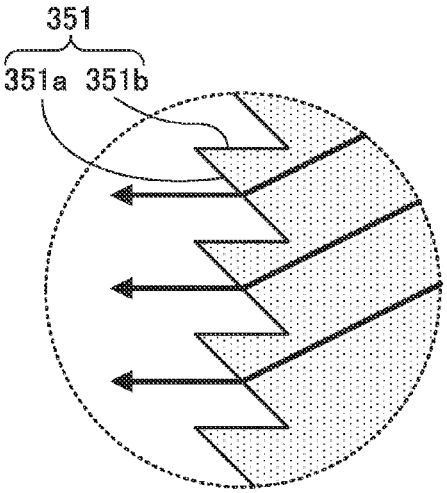
FIG. 14A is a view illustrating an example of enlarged irregularities formed on an outer peripheral surface of the holder.
Figure 14B:
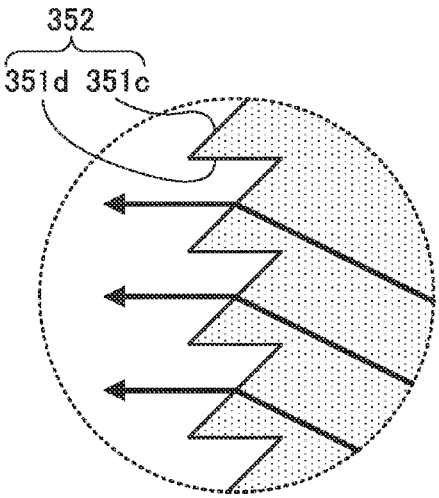
FIG. 14B is a view illustrating another example of the enlarged irregularities formed on the outer peripheral surface of the holder.

Furthermore, irregularities for adjusting an emitting direction of light emitted from a holder may be formed on an outer peripheral surface of the holder. FIG. 14A is a view illustrating an example of enlarged irregularities formed on the outer peripheral surface of the holder. FIG. 14B is a view illustrating another example of the enlarged irregularities formed on the outer peripheral surface of the holder.

Multiple recesses 351 have the same shape as each other and are arranged at regular intervals. The shape of recess 351 is rotationally symmetric whose rotation axis is a central axis (for example, central axis CA1 or CA2) of holder 150. The shape of recess 351 in a cross section which passes through the central axis of holder 150 is a right triangle.

As illustrated in FIG. 14A, recess 351 has inclined surface 351*a* in which an outer diameter of holder 150 is gradually decreased toward the rear side of holder 150 and annular plane 351*b* which extends outward from a rear side end of inclined surface 351*a* and is orthogonal to the central axis of holder 150. Inclined surface 351*a* changes a travelling direction of light which is reflected on second light flux controlling member 140 and reaches holder 150 from the front side of holder 150 so as to be close to a direction orthogonal to optical axis LA of light emitting element 110.

A recess may be recess 352 illustrated in FIG. 14B. Recess 352 has inclined surface 351*c* in which the outer diameter of holder 150 is gradually decreased toward the front side of holder 150 and plane 351*d* which extends outward from a front side end of inclined surface 351*c* and is orthogonal to the central axis of holder 150. Recess 352 changes a travelling direction of light which reaches holder 150 from the rear side of holder 150 so as to be close to a direction orthogonal to optical axis LA of light emitting element 110 (sideward).

The shape of the recess is not particularly limited as long as there is provided a surface, such as inclined surface 351*a* and inclined surface 351*c*, which changes the travelling direction of the light from the front side or from the rear side so as to be close to a lateral direction. Such a surface also includes a surface whose generating line is a curve. Instead of holder 150 described above, even by using the holder having irregularities, it is possible to obtain a lighting device having light distribution characteristics similar to the incandescent lamp.

In addition, the shape of the housing is not limited to the shape including the tapered surface. For example, the housing may be formed in a columnar body which is straight along optical axis LA. The shape of the housing is not limited to a shape which is rotationally symmetric. For example, the shape of a cross section which is orthogonal to optical axis LA of the housing may be a polygon such as a rectangle, or may be a non-circular shape such as an elliptical shape. Even by using such a housing, as long as the housing has a shape which satisfies the above-described relationship between a and 0, it is possible to obtain a lighting device having light distribution characteristics similar to the incandescent lamp.

INDUSTRIAL APPLICABILITY

A lighting device according to the present invention can be widely applied to various pieces of illumination equipment such as chandeliers and indirect lighting devices, since the apparatus can be used instead of an incandescent lamp.

REFERENCE SIGNS LIST

10, 100 to 500 Lighting device
11 LED
12 Light emission surface
13, 160, 360, 460 Cover
14,171 Edison screw
110 Light emitting element
120 Light flux controlling member
130, 230 First light flux controlling member
131 Refraction portion
132 Fresnel lens section
132*a* Annular projection
132*b* First inclined surface
132*c* Second inclined surface
133 Emission surface
134, 142 Flange
140 Second light flux controlling member
141 Reflection surface
143 Fitting portion
144, 351, 352 Recess
150 Holder
151 End surface
152 Guide projection
153 Pawl
155 Boss
156 Vent
157 Locking pawl
170, 270, 470 Housing
172, 272, 472 First tapered surface
172*a*, 272*a*, 472*a* Front end edge of first tapered surface
173, 273 Second tapered surface
174, 474 Annular end surface
175, 275 Protruding portion
231 Incidence surface
232 Total reflection surface
351*a*, 351*c* Inclined surface
351*b*, 351*d* Plane
CA, CA1, CA2 Central axis
LA Optical axis

The invention claimed is:

1. A lighting device comprising:

a light emitting element for emitting light toward a forward direction of the lighting device;

a light flux controlling member for emitting a part of light, the light being emitted toward the forward direction from the light emitting element, toward a lateral direction or a rear direction of the lighting device, the light flux controlling member being arranged on an optical axis of the light emitting element, and comprising a first light flux controlling member and a second light flux controlling member;

a cover that covers the light flux controlling member for transmitting light emitted from the light flux controlling member with the light being diffused; and a housing that supports the light emitting element, the light flux controlling member and the cover, wherein the first light flux controlling member is arranged opposing the light emitting element for emitting a part of light that is emitted from the light emitting element and reaches the first light flux controlling member toward the second light flux controlling member, the first light flux controlling member has an incidence surface on which a part of the light emitted from the light emitting element is incident, a total reflection surface that reflects a part of the light which has been incident on the incidence surface toward the second light flux controlling member, and an emission surface that emits a part of the light which has been incident on the incidence surface and the light which has been reflected on the total reflection surface toward the second light flux controlling member, the second light flux controlling member has a reflection surface that faces to an emission surface of the first light flux controlling member for reflecting a part of light emitted from the first light flux controlling member and reaches the second light flux controlling member, and for transmitting the remaining light, the reflection surface is a rotationally symmetric surface whose rotation axis is the optical axis, and a generating line of the rotationally symmetric surface is formed to be a concave curve with respect to the first light flux controlling member, an outer peripheral portion of the reflection surface is disposed at a position away from the light emitting element in a direction of the optical axis, compared to a central portion of the reflection surface, the light emitted from the light flux controlling member has a peak in luminous intensity distribution of the light in a rearward direction which is a direction opposite to the direction of the light emitted from the light flux controlling member along the optical axis, and the housing has an outermost rim which is a most protruding portion relative to an optical path of light of angle $\theta$ where, provided that an angle of an emitting direction of light emitted forward from the light flux controlling member along the optical axis is set to 0°, in any cross-section including the optical axis, $\alpha$ is one of two angles formed at an intersection between the optical axis and a line which is tangent to an outer rim of the reflection surface and the outermost rim of the housing, wherein:

$\alpha$ is the greater angle formed at the intersection, and $\theta$ represents an angle relative to the optical axis in the rearward direction of the peak of luminous intensity distribution of the light emitted from an outer peripheral surface of the light flux controlling member.

2. The lighting device according to claim 1, wherein the housing further has a base with which an opening of the cover comes in contact and the tapered surface inclines at an angle of $\beta$ relative to the optical axis, wherein a distance between the tapered surface and the optical axis is gradually increased toward the rear direction of the lighting device from an outer rim of the base, and wherein the housing has a shape such that β is θ or greater, where, in any cross-section including the optical axis, β is one of two angles formed at an intersection between a straight line along the tapered surface and the optical axis, the β being the greater angle.

3. The lighting device according to claim 1, wherein a shape of the cover is a spherical crown shape.

* * * * *